US009099238B2

(12) United States Patent
Eriksson et al.

(10) Patent No.: US 9,099,238 B2
(45) Date of Patent: Aug. 4, 2015

(54) HIGH VOLTAGE INSULATION SYSTEM AND A HIGH VOLTAGE INDUCTIVE DEVICE COMPRISING SUCH AN INSULATION SYSTEM

(71) Applicants: Anders Bo Eriksson, Ludvika (SE); Erik Wedin, Ludvika (SE); Jan Lindgren, Grangesberg (SE); Mats Berglund, Ludvika (SE); Mats Ramkvist, Ludvika (SE); Stina Bertilsson, Smedjebacken (SE); Tina Brunstrom, Ludvika (SE)

(72) Inventors: Anders Bo Eriksson, Ludvika (SE); Erik Wedin, Ludvika (SE); Jan Lindgren, Grangesberg (SE); Mats Berglund, Ludvika (SE); Mats Ramkvist, Ludvika (SE); Stina Bertilsson, Smedjebacken (SE); Tina Brunstrom, Ludvika (SE)

(73) Assignee: ABB TECHNOLOGY AG (CH)

( * ) Notice: Subject to any disclaimer, the term of this patent is extended or adjusted under 35 U.S.C. 154(b) by 0 days.

(21) Appl. No.: 14/255,259

(22) Filed: Apr. 17, 2014

(65) Prior Publication Data

US 2014/0225697 A1 Aug. 14, 2014

Related U.S. Application Data

(63) Continuation of application No. PCT/EP2012/070702, filed on Oct. 18, 2012.

(30) Foreign Application Priority Data

Oct. 18, 2011 (EP) ..... 11185609

(51) Int. Cl.

| | |
|---|---|
| ***H01F 27/02*** | (2006.01) |
| ***H01F 27/10*** | (2006.01) |
| ***H01F 27/08*** | (2006.01) |
| ***H01F 27/32*** | (2006.01) |
| ***H01F 27/12*** | (2006.01) |

(52) U.S. Cl.
CPC ..... *H01F 27/322* (2013.01); *H01F 27/12* (2013.01)

(58) Field of Classification Search
USPC ..... 336/94
See application file for complete search history.

(56) References Cited

U.S. PATENT DOCUMENTS

| | | | |
|---|---|---|---|
| 3,548,354 | A | 12/1970 | Schwab |
| 4,000,482 | A | 12/1976 | Staub et al. |

FOREIGN PATENT DOCUMENTS

| | | | |
|---|---|---|---|
| CA | 2495382 | A1 * | 4/2004 |
| CH | 232439 | A | 5/1944 |

(Continued)

OTHER PUBLICATIONS

International Search Report and Written Opinion of the International Searching Authority Application No. PCT/EP2012/070702 Completed: Jan. 23, 2013; Mailing Date: Feb. 1, 2013 12 pages.

*Primary Examiner* — Elvin G Enad
*Assistant Examiner* — Ronald Hinson
(74) *Attorney, Agent, or Firm* — Whitmyer IP Group LLC

(57) ABSTRACT

An insulation system for a winding structure. The insulation system includes an innermost barrier pair arranged to cover a majority of the winding structure in the axial direction of the winding structure inside and outside the barrier structure relative the curvature of winding turns of windings of the winding structure, wherein at least one barrier of the innermost barrier pair defines a first flow path allowing flow of a dielectric fluid mainly in a first axial direction between the winding structure and the at least one barrier when the insulation system is in a assembled state; and a first outer barrier arranged radially inwards or radially outwards relative each barrier of the innermost barrier pair, wherein the first outer barrier defines a second flow path, parallel to the first flow path, allowing flow of a dielectric fluid mainly in a second axial direction opposite the first axial direction.

19 Claims, 3 Drawing Sheets

(56) References Cited

FOREIGN PATENT DOCUMENTS

| | | | |
|---|---|---|---|
| DE | 873721 | C | 4/1953 |
| DE | 2016508 | A1 | 10/1972 |
| EP | 0785560 | A1 | 7/1997 |
| JP | S5442620 | A | 4/1979 |
| JP | S58157115 | A | 9/1983 |
| JP | S61150309 | A | 7/1986 |

* cited by examiner

HIGH VOLTAGE INSULATION SYSTEM AND A HIGH VOLTAGE INDUCTIVE DEVICE COMPRISING SUCH AN INSULATION SYSTEM

FIELD OF THE INVENTION

The present disclosure generally relates to high voltage power systems and in particular to an insulation system for an inductive device in a high voltage power system and to a high voltage inductive device comprising such an insulation system.

BACKGROUND OF THE INVENTION

In high voltage power systems such as those handling 100 kV and above, proper insulation of equipment such as inductive devices is necessary so as to ensure the safe operation thereof. Moreover, due to the high powers involved, energy losses generate such quantities of heat in for instance inductive elements that cooling may be necessary.

Windings in high voltage inductive devices such as reactors and transformers are typically cooled by means of a dielectric fluid such as transformer oil, which can absorb the heat generated in the winding. When oil is absorbing heat in the winding, it has to escape from the winding and be replaced by cool oil which can absorb additional heat. Therefore, an oil channel can be provided in an insulation system which insulates the winding. Insulation systems may for instance be provided with an oil channel of horizontal oil ducts which are arranged in a horizontal zig-zag pattern at the upper end and at the lower end of the winding.

JP61150309 discloses an oil-circulating transformer winding for obtaining high cooling efficiency. The oil enters the cooling structure at one end of the winding and exits the cooling structure at the opposite end of the winding via vertical oil passages which are formed by insulating tubes for vertical oil flow so as to allow oil to cool the transformer winding.

CH232439 discloses an insulation system for a transformer winding. The insulation system has barriers which allows for flow of oil in opposite directions at one end of the winding.

DE873721 also discloses an insulation system for a transformer winding. The system has barriers arranged with openings for allowing oil to flow in a zig-zag pattern in the axial direction.

A drawback with the prior art is that they do not provide sufficient dielectric properties on both ends of the winding in some cases, for example in some high voltage direct current applications (HVDC).

SUMMARY OF THE INVENTION

An object of the present disclosure is to provide an improved insulation system for a winding structure. In particular, it would be desirable to achieve an insulation system which when arranged in an inductive device for insulating a winding structure increases the electric withstand strength of the inductive device. It would moreover be desirable to be able to provide an insulation system that is more robust and simpler to manufacture.

Hence, according to a first aspect of the present disclosure, there is provided an insulation system for a winding structure, the insulation system comprising: an innermost barrier pair arranged to cover a majority of the winding structure in the axial direction of the winding structure inside and outside the barrier structure relative the curvature of winding turns of windings of the winding structure, wherein at least one barrier of the innermost barrier pair defines a first flow path allowing flow of a dielectric fluid mainly in a first axial direction between the winding structure and the at least one barrier when the insulation system is in a assembled state; and a first outer barrier arranged radially inwards or radially outwards relative each barrier of the innermost barrier pair, wherein the first outer barrier defines a second flow path, parallel to the first flow path, allowing flow of a dielectric fluid mainly in a second axial direction opposite the first axial direction, wherein the insulation system is arranged such that a dielectric medium is able to flow from the second flow path and enter the first flow path at one axial end portion of one of the barriers of the innermost barrier pair and at the other axial end portion of one of the barriers of the innermost barrier pair exit the corresponding first flow path, wherein each barrier of the innermost barrier pair has a contiguous envelope surface extending between the one axial end portion and the other axial end portion of each barrier of the innermost barrier pair.

An effect which may be obtainable thereby, is that the creepage path becomes longer at both ends of the winding, because the dielectric fluid flows changes axial direction at least one time upon entry to and exit from the insulation system, thereby improving the performance of the creepage path along the flow paths at the axial end portions of the winding structure. Moreover, a more robust insulation system may be provided, as the innermost barrier pair has fewer openings than prior art solutions. This also simplifies the production of the insulation system. Additionally, the production/design of the insulation system is greatly simplified because few creepage paths are provided, one for each fluid communication channel between parallel flow paths, as compared to the prior art, where there is one creepage path for each opening of the plurality of openings in the insulation. Furthermore, the dielectric strength is improved as fewer openings between flow paths provide a higher dielectric strength.

With creepage path is generally meant the shortest path between two conductive parts, or between a conductive part and the bounding surface of the equipment, e.g. a winding structure, measured along the surface of the insulation system.

One embodiment comprises a first static shield ring for arrangement at a first end of the winding structure in axial alignment therewith, wherein the one axial end portion of each barrier of the innermost barrier pair is located in a region that is electrically shielded by the first static shield ring.

One embodiment comprises a second static shield ring for arrangement at a second end of the winding structure in axial alignment therewith, wherein the other axial end portion of each barrier of the innermost barrier pair is located in a region that is electrically shielded by the second static shield ring.

One embodiment comprises a second outer barrier arranged radially inwards or radially outwards from the first outer barrier, wherein the second outer barrier has a surface defining a third flow path for the dielectric fluid, wherein at least one of the barriers of the innermost barrier pair is arranged to provide fluid communication between a first flow path and the second flow path, and the first outer barrier is arranged to provide fluid communication between the second flow path and the third flow path such that dielectric fluid flowing through the insulation system has axial components in the first axial direction in the first flow path and the third flow path and axial components in the second axial direction in the second flow path.

According to one embodiment, the first outer barrier and the second outer barrier are so arranged that dielectric fluid enters and exits the insulation system by means of the third flow path.

According to one embodiment at least one of the barriers of the innermost barrier pair has a first opening at the one axial end portion and a second opening at the other axial end portion arranged to provide fluid communication between a first flow path and the second flow path.

According to one embodiment the first outer barrier has a first opening and a second opening arranged to provide fluid communication between the second flow path and the third flow path.

According to one embodiment the first opening and the second opening of the first outer barrier are axially displaced, wherein the first opening is arranged in a portion of a first half of the first outer barrier and the second opening is arranged in a portion of a second half of the first outer barrier.

According to one embodiment the first opening of the at least one barrier of the innermost barrier pair is axially displaced in relation to the first opening of the first outer barrier.

According to one embodiment the second opening of the at least one innermost barrier pair of the innermost barrier pair is axially displaced in relation to the second opening of the first outer barrier.

According to one embodiment each of the first opening and the second opening of the first outer barrier is arranged upstream of the first opening of the at least one barrier of the innermost barrier pair and downstream of the second opening of the at least one barrier of the innermost barrier pair with respect to the first axial direction.

According to one embodiment the first flow path, the second flow path, and the third flow path define vertical flow paths in the insulation system.

According to one embodiment the innermost barrier pair and the first outer barrier are made of cellulose-based material.

The insulation system according to the first aspect presented herein may advantageously be utilised in a high voltage inductive device. Hence, according to a second aspect of the present disclosure there is provided a high voltage inductive device comprising an insulation system of any variation of the first aspect.

According to one embodiment the high voltage inductive device is an HVDC transformer.

According to one embodiment the high voltage inductive device is an HVDC reactor.

Generally, all terms used in the claims are to be interpreted according to their ordinary meaning in the technical field, unless explicitly defined otherwise herein. All references to "a/an/the element, apparatus, component, means, are to be interpreted openly as referring to at least one instance of the element, apparatus, component, means, etc., unless explicitly stated otherwise.

BRIEF DESCRIPTION OF THE DRAWINGS

The inventive concept will now be described, by way of example, with reference to the accompanying drawings, in which.

DETAILED DESCRIPTION OF THE INVENTION

Figure 1:
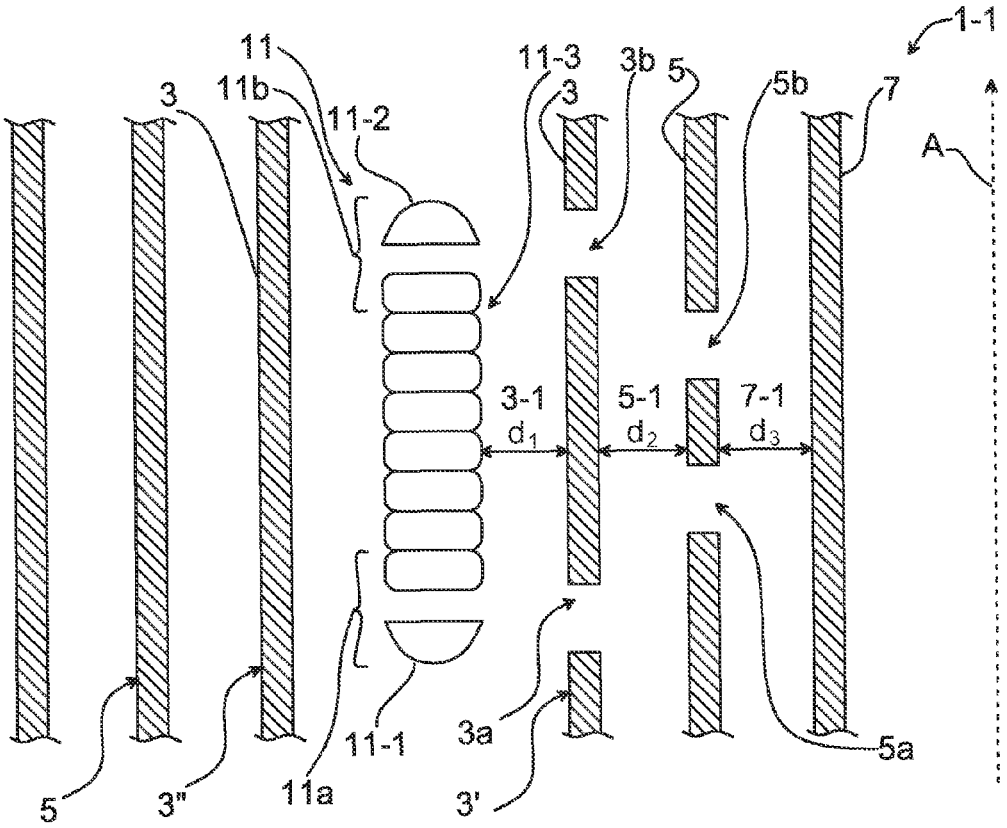
FIG. 1 shows a schematic cross-sectional side view of a first example of an insulation system.

The inventive concept will now be described more fully hereinafter with reference to the accompanying drawings, in which certain embodiments of the inventive concept are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art.

Examples of an insulation system for electrically insulating a winding structure having a first end portion and a second end portion are presented in the following. The insulation system comprises an innermost barrier pair arranged to cover a majority of the winding structure in the axial direction of the winding structure inside and outside the barrier structure relative the curvature of winding turns of windings of the winding structure. At least one barrier of the innermost barrier pair defines a first flow path allowing flow of a dielectric fluid mainly in a first axial direction between the winding structure and the at least one barrier of the innermost barrier pair when the insulation system is in an assembled state. The insulation system further comprises a first outer barrier arranged radially inwards or radially outwards relative each barrier of the innermost barrier pair innermost barrier pair, wherein the first outer barrier defines a second flow path, parallel to the first flow path, allowing flow of a dielectric fluid mainly in a second axial direction opposite the first axial direction, wherein the insulation system is arranged such that a dielectric medium is able to flow from the second flow path and enter the first flow path at one axial end portion of one of the barriers of the innermost barrier pair and at the other axial end portion of one of the barriers of the innermost barrier pair exit the corresponding first flow path, wherein each barrier of the innermost barrier pair has a contiguous envelope surface extending between the one axial end portion and the other axial end portion of each barrier of the innermost barrier pair.

With the innermost barrier pair covering a majority of the winding structure is meant that the innermost barrier pair has a length that is at least half the length of the winding structure.

With dielectric fluid flow mainly in a first or second axial direction is meant that although dielectric fluid may flow in other directions, most of the fluid flow is in the first or second axial direction. In particular, three orthogonal components define the direction in which a dielectric fluid can flow in space. Thus, fluid flowing along a flow path mainly in an axial direction means that the dominating component, i.e. the component of largest magnitude of the three components in space, is an axial component, where an axial component is a component that is parallel with the axial extension of the winding structure.

A great plurality of variations of the insulating system is possible for implementing the above-described functionality. Only a few examples will be given herein.

FIG. 1 shows a first example of an insulation system 1-1 for a winding structure 11 having a first end portion 11*a* with a first end 11-1 and a second end portion 11*b* with a second end 11-2. It is to be noted that the winding structure is not to scale, especially concerning length relative width dimensions.

The insulation system 1-1 is arranged to electrically insulate the winding structure 11 from its surroundings, and to allow a dielectric fluid to flow via flow paths of the insulation system 1-1 so as to cool the winding structure 11 when current is applied to the winding structure 11. Moreover, the insulation system 1-1 improves the performance of the creepage path from the winding structure 11 to e.g. a grounded surface of the interior of an inductive device containing the winding structure 11 and the insulation system 1-1.

The exemplified insulation system 1-1 has an innermost barrier pair 3, essentially concentric barriers 3' and 3", and a first outer barrier 5. Innermost barrier pair is to be construed to mean innermost relative the winding structure 11. With a first/second outer barrier is herein meant a barrier that is not the barrier closest to the winding structure 11. The insulation system 1-1 may additionally comprise a second outer barrier 7. It is to be noted that as a variation of the depicted example, both barriers 3' and 3" could have the same design or similar design.

The innermost barrier pair 3 is arranged to cover or enclose the winding structure 11 from both the inside and the outside the winding structure 11 relative a curvature of the winding turns of windings of the winding structure 11. In particular one barrier 3' of the innermost barrier pair 3 is arranged to enclose or cover a majority of the winding structure 11 along the axial direction A on the inside of the winding structure 11. The other barrier 3" of the innermost barrier pair 3 is arranged to enclose or cover a majority of the winding structure 11 along the axial direction A on the outside of the winding structure 11. Thus, one barrier 3' of the innermost barrier pair 3 is arranged radially inwards relative the winding turns of the winding structure 11, and one barrier 3" of the innermost barrier pair 3 is arranged radially outwards relative the winding turns of the winding structure 11.

The axial direction A of the winding structure 11 extends from the first end portion 11*a* to the second end portion 11*b*, i.e. in the longitudinal direction of each barrier 3', 3" of the innermost barrier pair 3.

When the insulation system 1-1 is assembled around the winding structure 11, the barriers 3, 3" of the innermost barrier pair 3 are distanced from an exterior surface 11-3 of the winding structure 11. In the example in FIG. 1, barrier 3' of the innermost barrier pair 3 is distanced at a distance $d_1$ from the exterior surface 11-3. The channel provided by means of the distance $d_1$ between the surface of the radially inner barrier 3' of the innermost barrier pair 3, facing the inner surface 11-3 of the winding 11 defines a first flow path 3-1 for the dielectric fluid in a first axial direction which is the same as the axial direction A, i.e. extending from the first end portion 11*a* to the second end portion 11*b*.

It is to be noted that a first flow path may according to one variation be provided also between the outer surface of the winding structure 11 and the barrier 3" which is on the outside of the winding structure 11, i.e. radially outwards of the winding structure.

The winding structure 11 has an axis of symmetry parallel to the axial direction A. The first outer barrier 5 is arranged radially outwards or radially inwards relative the innermost barrier pair 3 and is arranged essentially in parallel with each barrier 3', 3" of the innermost barrier pair 3. If two first outer barriers are utilised, one can be arranged radially inwards relative the innermost barrier pair 3, and the other can be arranged radially outwards relative the innermost barrier pair 3. A surface of the first outer barrier 5 defines a second flow path 5-1 for the dielectric fluid. Although in this particular example the first outer barrier is the barrier subsequent to the inner barrier, i.e. barrier 3', of the innermost barrier pair in the radial direction, it should be noted that the first outer barrier does not necessarily have to be the subsequent barrier relative the inner barrier 3' or the outer barrier 3" of the inner barrier pair 3; indeed there could be one or more intermediate barriers between the innermost barrier pair and the first outer barrier.

The first outer barrier 5 may be arranged at a distance $d_2$ from any of the barriers 3', 3" of the innermost barrier pair 3 whereby a channel is provided by means of the distance $d_2$ between the barrier 3', 3" of the innermost barrier pair 3 and the first outer barrier 5. The second flow path may hereby be defined by the channel between the innermost a barrier 3', 3" of the innermost barrier pair 3 and the first outer barrier 5. As noted hereabove, the second flow path could in a variation of the insulation system 1-1 have formed part of a channel defined by the inner surface of the first outer barrier and the outer surface of another barrier which is not the innermost barrier pair.

The second outer barrier 7 is arranged radially outwards or inwards relative the barriers 3', 3" of the first outer barrier 5. If two second outer barriers are utilised, one can be arranged radially inwards relative the first outer barrier and the other one can be arranged radially outwards relative the first outer barrier. The second outer barrier 7 has a surface defining a third flow path 7-1 for a dielectric fluid.

The second outer barrier 7 may be arranged at a distance $d_3$ from the first outer barrier 5 whereby a channel is provided by means of the distance $d_3$ between the first outer barrier 5 and the second outer barrier 7. The third flow path 7-1 may hereby be defined by the channel between the first outer barrier 5 and the second outer barrier 7.

According to any embodiment presented herein, the insulation system is arranged such that a dielectric medium is able to flow from outside one of the barriers of the innermost barrier pair to the first flow path of that barrier at one axial end portion of a barrier, and exit either the first flow path of the same barrier at the other axial end portion thereof or exit the first flow path of the other barrier of the innermost barrier pair at the other axial end portion of the other barrier. Each barrier of the innermost barrier pair has a contiguous envelope surface extending between the one axial end portion and the other axial end portion. Thus, the entire envelope surface of each barrier of the innermost barrier pair extending between the one axial end portion and the other axial end portion is contiguous. This contiguous surface does hence not have any through openings that would allow dielectric fluid to flow through the innermost barrier pair.

Figure 2:
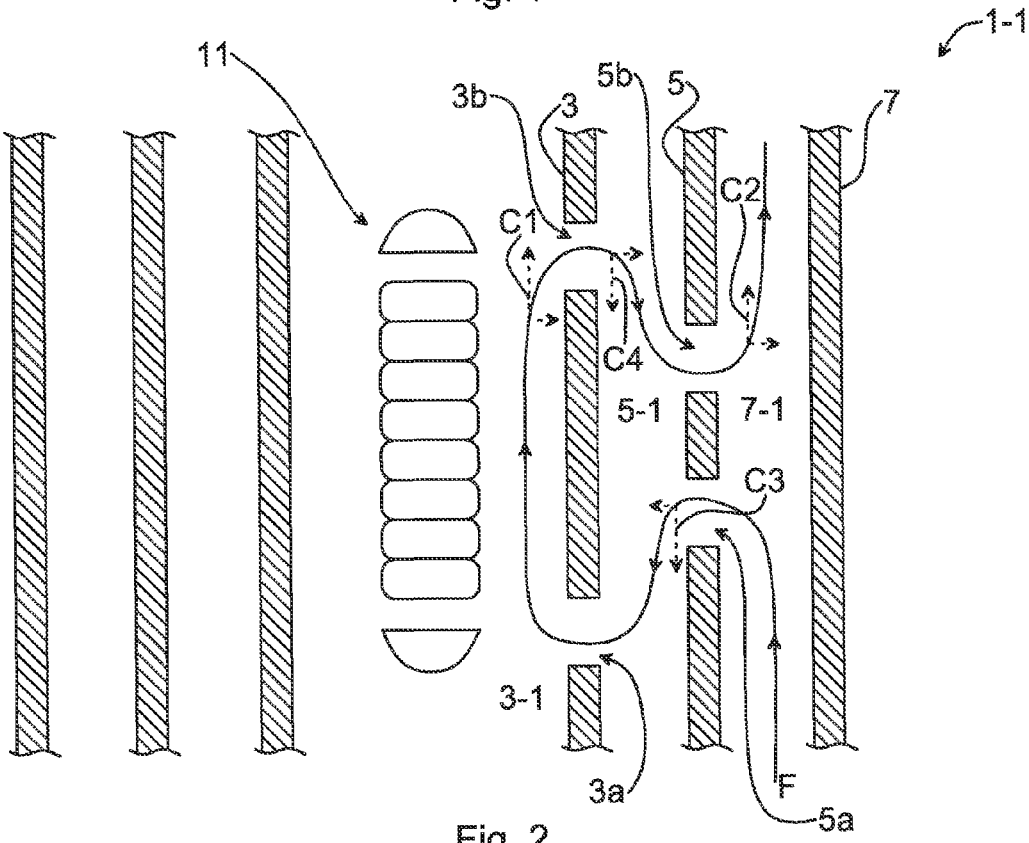
FIG. 2 shows a schematic cross-sectional side view of the first example in FIG. 1 when in operation.

According to the example depicted in FIGS. 1-2, the innermost barrier pair 3 is arranged to provide fluid communication between the first flow path 3-1 and the second flow path 5-1. The first outer barrier 5 is arranged to provide fluid communication between the second flow path 5-1 and the third flow path 7-1. A fluid communication between each of the first flow path 3-1, the second flow path 5-1 and the third flow path 7-1 can thereby be provided. The fluid communication is provided in such a way that any dielectric fluid F flowing through the insulation system 1-1 has axial components C1, C2 in the first axial direction in the first flow path 3-1 and the third flow path 7-1 and axial components C3, C4 in a second axial direction opposite the first axial direction in the second flow path 5-1. In particular the dielectric fluid may have axial components C3, C4 in a direction opposite the first axial direction axially essentially in level with the first end portion 11*a* and the second end portion 11*b*. At least one of the barriers 3', 3" of the innermost barrier pair 3, the first outer barrier 5 and the second outer barrier 7 are hence so arranged in relation to each other that the dielectric fluid changes flow direction axially in level with the first end portion 11*a* and the second end portion 11*b*. The insulation system may according to any example presented herein comprise a first static shield ring for arrangement at a first end of the winding structure, as indicated by the first end portion 11*a*, in axial alignment therewith. According to this example the one axial end portion of the innermost barrier pair is advantageously located in a region that is electrically shielded by the first static shield ring. The insulation system may according to one example comprise a second static shield ring for arrangement at a second end of the winding structure, as indicated by the second end portion 11*b*, in axial alignment therewith. According to this example, the other axial end portion of the barriers 3', 3" of the innermost barrier pair 3 is advantageously located in a region that is electrically shielded by the second static shield ring. Thus, the insulation system may have one or two static shield rings.

One or both barriers 3', 3" of the innermost barrier pair 3 may comprise a first opening 3*a* at the one axial end portion and a second opening 3*b* at the other axial end portion arranged to provide the fluid communication between the first flow path 3-1 and the second flow path 5-1.

The first outer barrier 5 may comprise a first opening 5*a* and a second opening 5*b* arranged to provide the fluid communication between the second flow path 5-1 and the third flow path 7-1.

The first opening 3*a* and the second opening 3*b* of a barrier 3', 3" of the innermost barrier pair 3 are preferably axially displaced in the axial direction A. A dielectric fluid can thereby enter the first flow path 3-1 through the first opening 3*a* and exit the first flow path 3-1 through the second opening 3*b* when the dielectric fluid flows in the first axial direction.

According to the present example, the first opening 3*a* is arranged in a portion of a first half of barrier 3' of the innermost barrier pair 3 and the second opening 3*b* is arranged in a portion of a second half of barrier 3' of the innermost barrier pair, the first half and the second half being halves of the insulation system 1-1 in the axial direction A.

The first opening 5*a* and the second opening 5*b* of the first outer barrier 5 are axially displaced in the axial direction A. A dielectric fluid can thereby enter the second flow path 3-1 through the first opening 5*a* and exit the second flow path 3-1 through the second opening 5*b* when the dielectric fluid flows in the first axial direction.

The first opening 5*a* may be arranged in a portion of a first half of the first outer barrier 5 and the second opening 5*b* may be arranged in a portion of a second half of the first outer barrier 5, the first half and the second half being halves of the insulation system 1-1 in the main direction A.

The first opening 3*a* of barrier 3' of the innermost barrier pair 3 are axially displaced in relation to the first opening 5*a* of the first outer barrier 5. The second opening 3*b* of the innermost barrier pair 3 may be axially displaced in relation to the second opening 5*b* of the first outer barrier 5.

According to one variation of the insulation system, each of the first opening 5*a* and the second opening 5*b* of the first outer barrier 5 is arranged upstream of the first opening 3*a* of barrier 3' of the innermost barrier pair 3 and downstream of the second opening 3*b* of barrier 3' of the innermost barrier pair 3 with respect to the first axial direction.

The first flow path 3-1, the second flow path 5-1, and the third flow path 7-1 provides a zig-zag flow path axially for the dielectric fluid. The first flow path 3-1, the second flow path 5-1, and the third flow path 7-1 preferably define vertical flow paths in the insulation system 1-1. It is however to be understood that the flow paths may have any orientation depending on the orientation of the winding structure 11.

In one embodiment the first outer barrier 5 and the second outer barrier 7 are arranged such that the dielectric fluid enter and exits the insulation system 1-1 by means of the third flow path 7-1. The third flow path 7-1 hence functions as an entry point into the insulation system 1-1, and as an exit point from the insulation system 1-1. It is to be noted that a second outer barrier pair may be formed by second outer barrier arranged radially inwards relative the windings structure 11, and a second outer barrier arranged radially outwards relative the winding structure 11, in a design analogous to that of the innermost barrier pair. It is envisaged that with such a design, in one variation hereof the dielectric fluid may enter the insulation system by means of a third flow path in the inner, i.e. radially inwards relative the winding structure, second outer barrier of the second outer barrier pair, and that the dielectric fluid may exit the insulation system by means of the third flow path in the outer second outer barrier. Alternatively, the dielectric fluid could enter the insulation system by means of a third flow path in the outer, i.e. radially outwards relative the winding structure, second outer barrier of the second outer barrier pair, and that the dielectric fluid may exit the insulation system by means of the third flow path in the inner second outer barrier.

It is to be noted that instead of, or in addition to the openings in barrier 3', barrier 3" may according to one variation be provided with openings, i.e. the barrier which is arranged radially outwards relative the winding structure 11 may be provided with openings of the kind described above in relation with barrier 3'.

Instead of utilising openings for fluid communication between the flow paths of the insulation system, fluid may flow from one flow path to another flow path around a barrier, e.g. a barrier of the innermost barrier pair. Hereto, the length of a barrier may be designed such that a dielectric fluid may flow along the entire or part of the axial extension of a barrier, and flow radially inwards or outwards to another flow path where the barrier terminates, i.e. where the barrier has its axial termination. Auxiliary barriers may be used to control the flow of the dielectric fluid, as can be seen in the example in FIG. 5. Alternatively, barrier openings may be combined with this design.

With reference to FIG. 2, the insulation system 1-1 will now be described in operation when a dielectric fluid F flows through the insulation system 1-1 for cooling the winding structure 11.

A dielectric fluid F, such as transformer oil, flows along the third flow path 7-1 as the dielectric fluid F flows towards the winding structure 11. In the third flow path 7-1 the dielectric fluid F flows in the first axial direction before entering the second flow path 5-1 via the first opening 5*a* of the first outer barrier 5. In the present example, the first opening 5*a* of the first outer barrier 5 is arranged downstream of the first opening 3*a* of barrier 3' of the innermost barrier pair 3 with respect to the first axial direction. The flow direction of the dielectric fluid F thereby obtains an axial component C3 opposite the first axial direction. The dielectric fluid F then enters the first flow path 3-1 through the first opening 3*a* of barrier 3' of the innermost barrier pair 3 for cooling the winding structure 11. Because the first opening 3*a* of barrier 3' of the innermost barrier pair 3 is arranged upstream of the first opening 5*a* of the first outer barrier 5 with respect to the first axial direction, the flow direction of the dielectric fluid F once again changes direction such that it has an axial component in the second axial direction which is opposite the first axial direction when cooling the winding structure 11.

Corresponding directional changes are obtained by means of the second opening 3*a* of barrier 3' of the innermost barrier pair 3 and the second opening 5*b* of the first outer barrier 5.

In the first flow path 3-1 the dielectric fluid F propagates in the first axial direction before entering the second flow path 5-1 via the second opening 3*b* of barrier 3' of the innermost barrier pair 3. In the present example, the second opening 3*b* of barrier 3' of the innermost barrier pair 3 is arranged downstream of the second opening 5*b* of the first outer barrier 5 with respect to the first axial direction. The flow direction of the dielectric fluid F thereby obtains an axial component C4 opposite the first axial direction when entering the second flow path 5-1 from the first flow path 3-1. The dielectric fluid F then enters the third flow path 7-1 through the second opening 5*b* of the first outer barrier 5. Because the second opening 5*b* of the first outer barrier 5 is arranged upstream of the second opening 3*b* of barrier 3' of the innermost barrier pair 3 with respect to the first axial direction, the flow direction of the dielectric fluid F once again changes direction so as to obtain an axial component C2 in the same direction as the first axial direction in the third flow path 7-1 before exiting the insulation system 1-1. Hence a zig-zag flow pattern can be obtained axially as the fluid flows radially inwards and outwards with respect to the winding structure 11.

Figure 3:
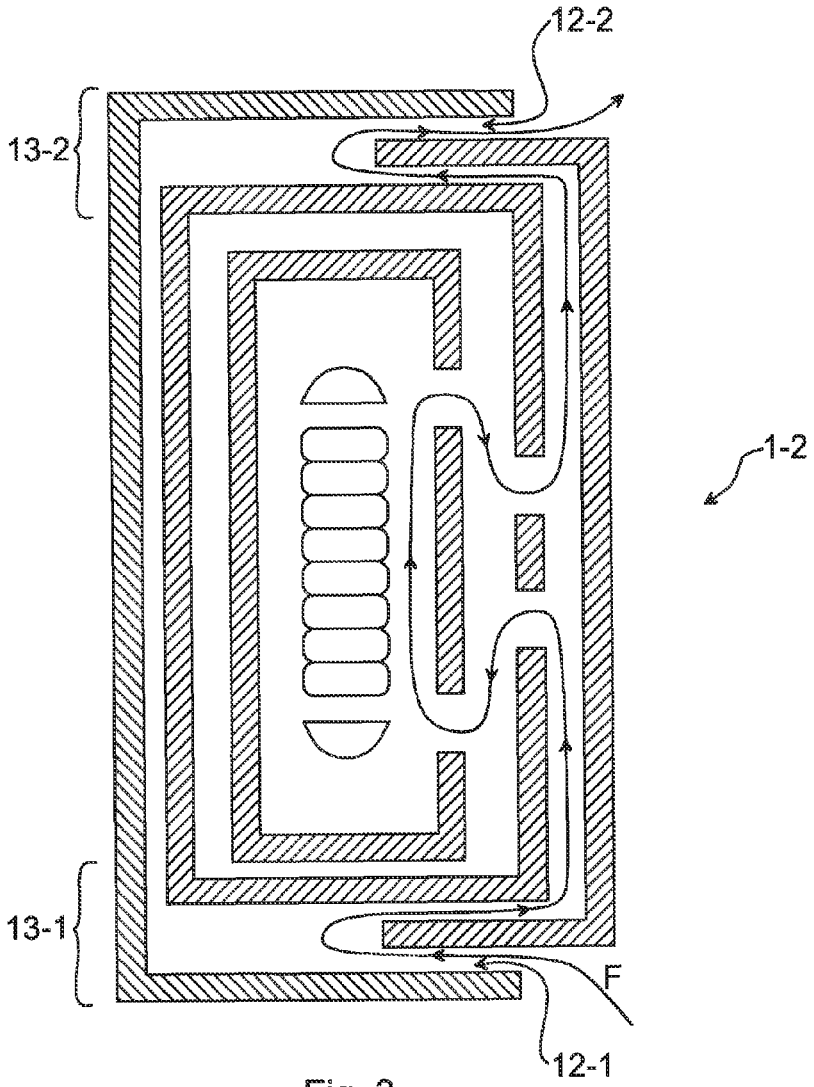
FIG. 3 shows a schematic cross-sectional side view of a second example of an insulation system.

With reference to FIG. 3 a second example of an insulation system 1-2 will now be described. The insulation system 1-2 is structurally the same with regards to the first flow path 3-1, the second flow path 5-1 and the third flow path 7-1. The second example 1-2 however further comprising flow paths which are transverse to the axial direction A. A first transverse flow path 12-1 is provided at a first end 13-1 of the insulation system 1-2 by which the dielectric fluid F can enter the insulation system 1-2. The first transverse flow path 12-1 may be connected to the third flow path 7-1.

A second transverse flow path 12-2 is provided at a second end 13-2 opposite the first end 13-1 of the insulation system 1-2 by which the dielectric fluid F can exit the insulation system 1-2. The second transverse flow path 12-2 may be connected to the third flow path 7-1.

The first transverse flow path 12-1 and the second transverse flow path 12-1 have a zig-zag pattern. A dielectric fluid F entering the insulating system 1-2 is thereby able to flow in a zig-zag pattern in directions transverse to the axial direction A in the first transverse flow path 12-1 and the second transverse flow path 12-2, and in directions essentially parallel to the axial direction A when flowing in the first flow path 3-1, the second flow path 5-1 and the third flow path 7-1, as has been described with reference to FIG. 2.

In one embodiment the first transverse flow path 12-1 and the second transverse flow path 12-2 are horizontal or essentially horizontal flow paths.

The first transverse flow path 12-1 and the second transverse flow path 12-1 may be formed by a distance between the first outer barrier 5 and the second outer barrier 7. Alternatively, the first transverse flow path and the second transverse flow paths may be physically separate collars which are connectedly arranged with the innermost barrier pair, the first outer barrier and the second outer barrier.

Figure 4:
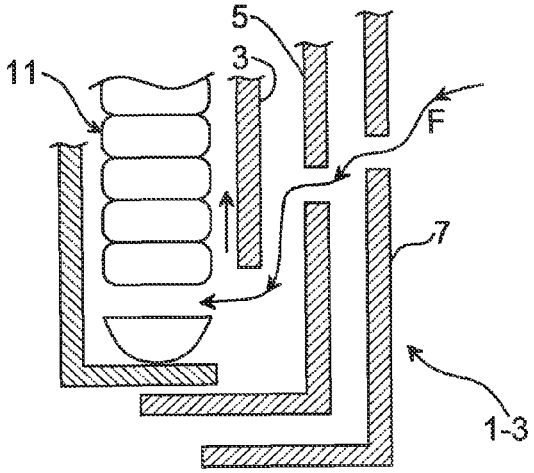
FIG. 4 shows a partial view of a third example of an insulation system.

FIG. 4 shows a partial view of a third example of an insulation system 1-3. The insulation system 1-3 comprises an innermost barrier pair 3, a first outer barrier 5, and a second outer barrier 7. The dielectric fluid F is arranged to enter the insulation system 1-3 via the second outer barrier 7. The innermost barrier pair 3, the first outer barrier 5, and the second outer barrier 7 are arranged such that the dielectric fluid F can change direction at the ends of the winding structure. The insulation system 1-3 is arranged such that the dielectric fluid F is able to flow locally in the insulating structure essentially in level with the first yoke and the second yoke in directions having axial components that are opposite to the main direction A, as defined above.

Figure 5:
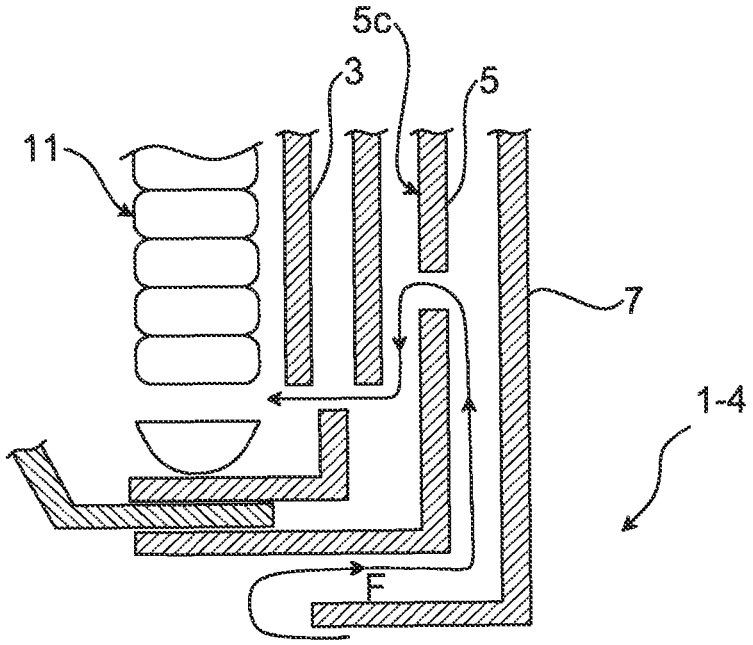
FIG. 5 shows a partial view of fourth example of an insulation system.
Figure 6:
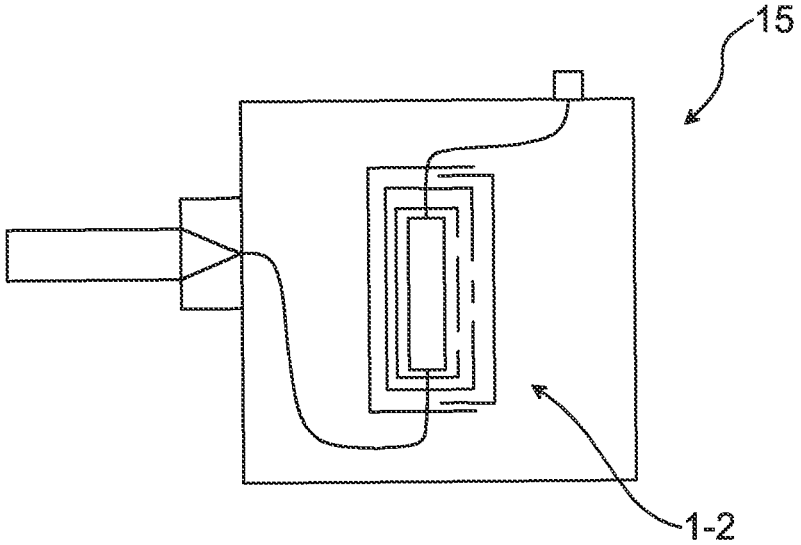
FIG. 6 shows an inductive device comprising an insulation system according to the present disclosure.

FIG. 5 shows a partial view of a fourth example of an insulation system 1-4. The insulation system 1-4 comprises an innermost barrier pair 3, a first outer barrier 5, and a second outer barrier 7. The dielectric fluid F is arranged to enter the insulation system 1-3 in a flow path between the first outer barrier 5 and the second outer barrier 7. The first outer barrier 5 has a surface 5*c* facing away from the second outer barrier 5 providing a flow path for the dielectric fluid F. The innermost barrier pair 3, the first outer barrier 5, and the second outer barrier 7 are arranged such that the dielectric fluid F can change direction at the ends of the winding structure. The insulation system 1-3 is arranged such that the dielectric fluid F is able to flow locally in the insulating structure essentially in level with the first yoke and the second yoke in directions having axial components that are opposite to the main direction A, as defined above.

In any example presented herein the insulating structure may be made of a cellulose-based material such as pressboard or paper.

The herein described insulation systems may for instance be used in a high voltage inductive device 15 such as a high voltage reactor or a high voltage transformer, as schematically shown in FIG. 7. The insulation system presented herein is particularly suitable for HVDC applications, e.g. for HVDC reactors and HVDC transformers. Inductive devices having several electrical phases may utilise one insulation system for each electric phase.

It is to be noted that any structural combination of the examples of insulating systems presented herein are possible. As an example, the transverse flow paths of the second example may for instance be included in the insulating system 1-1.

The inventive concept has mainly been described above with reference to a few embodiments. However, as is readily appreciated by a person skilled in the art, other embodiments than the ones disclosed above are equally possible within the scope of the invention, as defined by the appended claims. Additional barriers may be provided enclosing the innermost barrier with respect to the winding structure so as to provide additional zig-zag flow of a dielectric fluid flowing through the insulation system. The opposite end portions of the insulation system in the axial direction may have different designs for obtaining dielectric fluid flow at opposite ends of the winding structure in directions having axial components that are opposite to the main direction. Moreover, the insulation system does not have to be cylindrically symmetric.

What is claimed is:

1. An insulation system for a winding structure, the insulation system comprising:

an innermost barrier pair arranged to cover a majority of the winding structure in the axial direction of the winding structure inside and outside the barrier structure relative the curvature of winding turns of windings of the winding structure, wherein at least one barrier of the innermost barrier pair defines a first flow path allowing flow of a dielectric fluid mainly in a first axial direction between the winding structure and the at least one barrier of the innermost barrier pair when the insulation system is in a assembled state, and a first outer barrier arranged radially inwards or radially outwards relative each barrier of the innermost barrier pair, wherein the first outer barrier defines a second flow path, parallel to the first flow path, allowing flow of a dielectric fluid mainly in a second axial direction opposite the first axial direction, a second outer barrier arranged radially inwards or radially outwards from the first outer barrier, wherein the second outer barrier has a surface defining a third flow path for the dielectric fluid, wherein at least one of the barriers of the innermost barrier pair is arranged to provide fluid communication between a first flow path and the second flow path, and the first outer barrier is arranged to provide fluid communication between the second flow path and the third flow path such that dielectric fluid flowing through the insulation system has axial components in the first axial direction in the first flow path and the third flow path and axial components in the second axial direction in the second flow path, wherein the insulating system is arranged such that a dielectric medium is able to flow from the second flow path and enter the first flow path at one axial end portion of one of the barriers of the innermost barrier pair and at the other axial end portion of one of the barriers of the innermost barrier pair exit the corresponding first flow path, wherein each barrier of the innermost barrier pair has a contiguous envelope surface extending between the one axial end portion and the other axial end portion of each barrier of the innermost barrier pair.

2. The insulation system as claimed in claim 1, comprising a first static shield ring for arrangement at a first end of the winding structure in axial alignment therewith, wherein the one axial end portion of each barrier of the innermost barrier pair is located in a region that is electrically shielded by the first static shield ring.

3. The insulation system as claimed in claim 1, comprising a second static shield ring for arrangement at a second end of the winding structure in axial alignment therewith, wherein the other axial end portion of each barrier of the innermost barrier pair innermost barrier pair is located in a region that is electrically shielded by the second static shield ring.

4. The insulation system as claimed in claim 1, wherein the first outer barrier and the second outer barrier are so arranged that dielectric fluid enters and exits the insulation system by means of the third flow path.

5. The insulation system as claimed in claim 1, wherein at least one of the barriers of the innermost barrier pair has a first opening at the one axial end portion and a second opening at the other axial end portion arranged to provide fluid communication between a first flow path and the second flow path.

6. The insulation system as claimed in claim 1, wherein the first outer barrier has a first opening and a second opening arranged to provide fluid communication between the second flow path and the third flow path.

7. The insulation system as claimed in claim 6, wherein the first opening and the second opening of the first outer barrier are axially displaced, wherein the first opening is arranged in a portion of a first half of the first outer barrier and the second opening is arranged in a portion of a second half of the first outer barrier.

8. The insulation system as claimed in claim 6, wherein the first opening of the at least one barrier of the innermost barrier pair is axially displaced in relation to the first opening of the first outer barrier.

9. The insulation system as claimed in claim 6, wherein the second opening of the at least one barrier of the innermost barrier pair is axially displaced in relation to the second opening of the first outer barrier.

10. The insulation system as claimed in claim 8, wherein each of the first opening and the second opening of the first outer barrier is arranged upstream of the first opening of the at least one innermost barrier pair of the innermost barrier pair and downstream of the second opening of the at least one barrier of the innermost barrier pair with respect to the first axial direction.

11. The insulation system as claimed in claim 1, wherein the first flow path, the second flow path, and the third flow path define vertical flow paths in the insulation system.

12. The insulation system as claimed in claim 1, wherein the innermost barrier pair and the first outer barrier are made of cellulose-based material.

13. A high voltage inductive device comprising an insulation system as claimed in claim 1.

14. The high voltage inductive device as claimed in claim 13, wherein the high voltage inductive device is an HVDC transformer.

15. The high voltage inductive device as claimed in claim 13, wherein the high voltage inductive device is an HVDC reactor.

16. An insulation system for a winding structure, the insulation system comprising:

an innermost barrier pair arranged to cover a portion of the winding structure in an axial direction of the winding structure relative the curvature of winding turns of windings of the winding structure, at least one barrier of the innermost barrier pair defining a first flow path for the flow of a dielectric fluid in a first axial direction between the winding structure and the at least one barrier of the innermost barrier pair, a first outer barrier arranged radially inwards or radially outwards relative each barrier of the innermost barrier pair, the first outer barrier defining a second flow path, parallel to the first flow path, for the flow of the dielectric fluid in a second axial direction opposite the first axial direction, and a second outer barrier arranged radially inwards or radially outwards from the first outer barrier, the second outer barrier defining a third flow path for the dielectric fluid between the first outer barrier and the second outer barrier, at least one of the barriers of the innermost barrier pair provides fluid communication between the first flow path and the second flow path, and the first outer barrier is arranged to provide fluid communication between the second flow path and the third flow path such that the dielectric fluid flowing through the insulation system has axial components in the first axial direction in the first flow path and the third flow path and axial components in the second axial direction in the second flow path.

17. The insulation system as claimed in claim 16 where the insulating system constructed such that the dielectric fluid flows from the second flow path and enters the first flow path at a first axial end portion of one of the barriers of the innermost barrier pair and at a second axial end portion of one of the barriers of the innermost barrier pair exit the corresponding first flow path.

18. The insulation system as claimed in claim 16 where each barrier of the innermost barrier pair has a contiguous envelope surface extending between the one axial end portion and the other axial end portion of each barrier of the innermost barrier pair.

19. The insulation system as claimed in claim 16, wherein the first flow path, the second flow path, and the third flow path define vertical flow paths in the insulation system.

* * * * *